US008601648B2

(12) United States Patent
Poulakis

(10) Patent No.: US 8,601,648 B2
(45) Date of Patent: Dec. 10, 2013

(54) CLOSURE PART

(75) Inventor: Konstantinos Poulakis, Hildrizhausen (DE)

(73) Assignee: Gottlieb Binder GmbH & Co. KG, Holzgerlingen (DE)

( * ) Notice: Subject to any disclaimer, the term of this patent is extended or adjusted under 35 U.S.C. 154(b) by 2 days.

(21) Appl. No.: 13/138,515

(22) PCT Filed: Apr. 29, 2010

(86) PCT No.: PCT/EP2010/002632
§ 371 (c)(1),
(2), (4) Date: Aug. 30, 2011

(87) PCT Pub. No.: WO2010/124864
PCT Pub. Date: Nov. 4, 2010

(65) Prior Publication Data

US 2011/0314645 A1 Dec. 29, 2011

(30) Foreign Application Priority Data

Apr. 30, 2009 (DE) ..... 10 2009 019 671

(51) Int. Cl.
*A44B 18/00* (2006.01)

(52) U.S. Cl.
USPC ..... 24/452; 24/446; 428/100

(58) Field of Classification Search
USPC ..... 24/442, 447, 448, 450–452, DIG. 40; 428/100
See application file for complete search history.

(56) References Cited

U.S. PATENT DOCUMENTS

| | | | | |
|---|---|---|---|---|
| 4,001,366 | A | 1/1977 | Brumlik | |
| 5,799,378 | A * | 9/1998 | Gershenson et al. | 24/452 |
| 2004/0170801 | A1 | 9/2004 | Seth et al. | |
| 2013/0167332 | A1 * | 7/2013 | Terada et al. | 24/450 |
| 2013/0219677 | A1 * | 8/2013 | Idrizovic et al. | 24/452 |

FOREIGN PATENT DOCUMENTS

| | | | | |
|---|---|---|---|---|
| AT | 264 770 | 9/1968 | | |
| DE | 693 19 608 | 2/1999 | | |
| DE | 696 25 586 | 11/2003 | | |
| DE | 10 2005 048 215 | 4/2007 | | |
| DE | 60 2004 007 373 | 3/2008 | | |
| EP | 0 931 472 | 7/1999 | | |
| JP | 04279103 A | * 10/1992 | | A44B 18/00 |
| JP | 2004 321 338 | 11/2004 | | |
| WO | WO 94/09279 | 4/1994 | | |

* cited by examiner

*Primary Examiner* — Robert J Sandy
*Assistant Examiner* — Matthew Sullivan
(74) *Attorney, Agent, or Firm* — Roylance, Abrams, Berdo and Goodman LLP

(57) ABSTRACT

A closure part, particularly for forming hermaphroditic closures, has at least one carrier band (16) with a web shape and at least one pair of surface regions (17*a*, 17*b*) arranged opposite of each other and connectable at least partially along a connecting region (19) to a main body (26) as third component. Individual closure bodies (2) at least in part of the surface regions (17*a*, 17*b*) are located outside of the connecting region (19) and adjacent to it. The bodies protrude from the carrier band (16) and form a fixing feature (24) for further closure parts of the same or different kinds.

18 Claims, 7 Drawing Sheets

CLOSURE PART

FIELD OF INVENTION

The invention relates to a closure part, in particular for forming hermaphroditic closures.

BACKGROUND OF THE INVENTION

Such closure parts have a corresponding plurality of closure members as an essential component of touch-and-close fasteners. These fasteners have become widely known under the tradename "Kletten." The end regions of the stems of the interlocking members are affixed on a base body forming the carrier structure. This base body has a plate-shaped structure, preferably made of a readily injectable plastic material. The closure members are distributed in an arrangement in such that the interlocking heads that project beyond the base body are separated from each other at such a distance that the result is an interlocking engagement with the interlocking heads of another closure part to complete the touch-and-close fastener. If the interlocking heads of both interacting closure parts exhibit an identical shape, they are referred to as hermaphroditic closures.

DE 10 2005 048 215 A1 discloses a closure part of this type, where two closure members at a time form a cramp-shaped or U-shaped pair. Two stems of each pair are connected integrally to each other in pairs on their base sides by a transversely extending intermediate element. The attachment to the base body is carried out by inserting the stems of each pair through the openings in the base body from the back side of the base body, so that the transversely extending intermediate element can be pressed into a recess, extending between the openings, on the back side of the base body.

U.S. Pat. No. 5,799,378 discloses a closure part comprising two sets of walls, each of which extends parallel to each other in a grid structure, so that the sets of walls intersect at right angles. The intersecting points of the walls have the interlocking heads of the closure members. The mushroom-shaped interlocking heads can be formed as one piece with the walls, preferably made of a synthetic plastic material. The spacing or more specifically the sections between the walls are chosen such that when a second closure part engages with the first closure part, the interlocking heads of the second closure part engage with the respective open spaces of the grid structure and interlock the said first closure part by extending under its locking heads.

DE 60 2004 007 373 T2 discloses woven closure products having enhanced flame resistant properties. A woven closure product includes a loop component and a hook component designed to engage or rather mesh with the loop component. In each case, the components have a plurality of loops or hooks woven into a fabric base. The fabric base comprises woven, flame resistant fibers made of a polymer that melts or disintegrates when exposed to a flame.

DE 693 19 608 T2 discloses an interengaging fastening element used advantageously for fastening a window to a window frame of a motor vehicle. The fastening element has a base section and a plurality of engaging strips that project from the base section and extend parallel to each other in the longitudinal direction. Each engaging strip has a vertical portion adjoining the base section, a head portion adjoining the vertical portion, and two end faces. The engaging strips are designed to engage with the projecting head portion of an opposite fastening element, with the head portion of the engaging strips having a plurality of transverse slots and the vertical portions remaining unslotted. The transverse slots facilitate a sliding engagement of the fastening element with an opposite fastening element.

SUMMARY OF THE INVENTION

An object of the invention is to provide a touch-and-close closure part characterized by its especially good performance characteristics.

The invention basically achieves this object with a closure part, in particular for forming hermaphroditic closures, characterized by at least one web-shaped carrier strip having at least one pair of opposite surface region, connected at least partially to a base body as a third component along a connecting region and having individual closure members in at least one part of the surface regions. Those surface regions are located outside the connecting region and are adjacent thereto. The closure members protrude from the carrier strip and provide a possibility for securing additional closure parts of the same or different type.

Accordingly, an important particularity of the invention lies in the fact that the closure members can be connected to each other by a carrier strip such that they are spaced apart from each other and by the fact that the carrier strip extends more or less parallel to the respective closure member and not transversely thereto as in the solutions known from the prior art, where the stem of the respective closure member merges with a carrier surface and is usually an integral component of the same in a perpendicular arrangement.

The presence of a mechanical connection of the closure members by a carrier strip makes it possible to adjust the structural properties of the closure part to a desired optimum by selecting the dimensions and the material properties of the strip (rigidity) in such a way that the result is the desired interlocking forces. Another special advantage lies in the fact that when the initial product is manufactured, it is possible to manufacture a strip of any length with the closure members attached thereto so that the strip can be subdivided into the desired lengths and fed, for example, into a magazine that provides the components for insertion and from which a base body, such as a horizontally extending carrier surface, is populated.

Preferably, the arrangement is configured such that the respective closure member has an interlocking head and/or a stem adjoining the interlocking head and that the carrier strip rests flush with the respective closure member. At least portions of the stem and/or the interlocking head are then connected in a surface-to-surface manner to the surface regions of the carrier strip. In this way, this carrier strip forms a web with the closure members, laterally abutting the same and arranged in a row so as to form a chain. Preferably, both the surface sections of the interlocking head and the stem are connected in a surface-to-surface manner to the carrier strip.

Working on the basis of the aforesaid, the invention can provide in an especially advantageous manner that the interlocking head and/or stem are (is) connected in a surface-to-surface manner to the carrier strip over the entire axial reach relative to the longitudinal axis of the stem.

With respect to the connection of the interlocking members to the base body, the invention can provide that the carrier strip protrudes beyond that end of the stems of the interlocking members at a distance from the interlocking head to form an anchoring strip in the connecting region. This anchoring strip can be fastened in an anchoring groove of a base body forming the carrier structure of the closure part.

The invention can provide as an alternative that the carrier strip ends in front of that end of the stem of the interlocking members that is at a distance from the interlocking head. The protruding end regions of the stems then form fixing mandrels that can be fastened in the recesses that form the receptacles and are a part of the base body, forming the carrier structure of the closure part.

In especially advantageous embodiments, two closure members, which rest in alignment with each other against the one side and the other side of the carrier strip extending between them, form jointly an assembled closure element. Such an assembled closure element can be formed by two identical closure members, wherein preferably rows of assembled closure elements, which are arranged equidistant from each other, are formed on the carrier strip.

However, the arrangement can also be configured, as an alternative, such that a row of closure members, which are arranged equidistant from each other, is formed on the one side and the other side of the carrier strip. The rows can be offset relative to each other such that the closure members of the one row are located in the intermediate space between the closure members of the other row.

Furthermore, the invention comprises a closure with at least one closure part according to the invention and a base body, which is connected to the connecting region of the at least one carrier strip. In order to form a regular pattern of closure members on the closure part, the base body may be provided in this case with parallel anchoring grooves, arranged equidistant from each other, for the successive groups of carrier strips. In this case, too, the recesses in the base body are arranged preferably in parallel rows that are separated from each other.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF THE INVENTION

Figure 1:
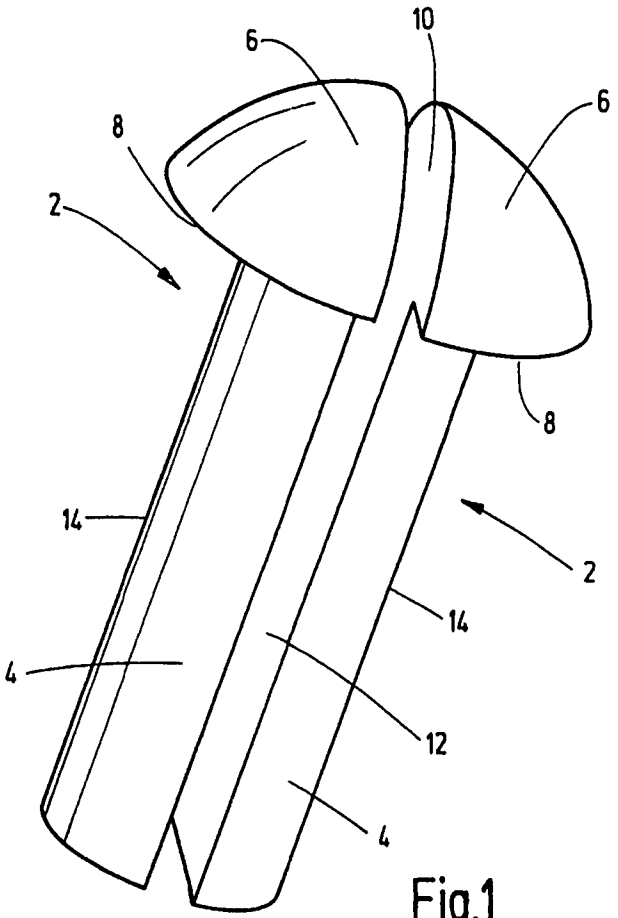
FIG. 1 is a perspective view of two identical closure members drawn according to a scale that is highly exaggerated compared to a practical embodiment, which closure members can be united in combination with a carrier strip (not illustrated in FIG. 1) to form a combined closure element of an exemplary embodiment of the closure part according to the invention.

The invention is explained below with the aid of exemplary embodiments, where the closure parts form an essential component of a hermaphroditic closure. In this context, the top end of the stems 4 of each closure member 2 in FIG. 1 has an interlocking head 6 more or less in the form of a mushroom head. The head 6 is defined by a circular arc-shaped contour line 8 and a planar head face 10. Head face 10 continues in a planar stem face 12 along the longitudinal axis of the stem 4. The stem face 12 is enveloped by a shell 14, corresponding to a portion of a circular cylinder, at the stem 4.

It is self-evident that the interlocking heads could have, instead of the illustrated mushroom head shape of the interlocking heads 6 with the circular arc-shaped contour line 8, a contour line that deviates from the circular shape, for example, a polygonal shape, or a different shape that deviates from the mushroom head shape. Similarly, the stems 4 could have a contour that deviates from the circular shape.

Figure 2:
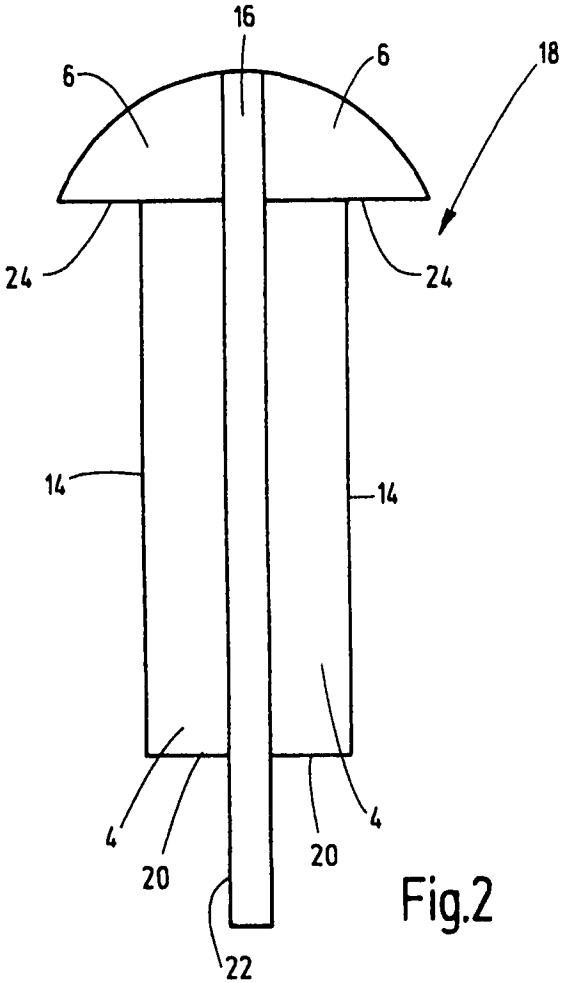
FIG. 2 is a side elevational view of the closure element drawn approximately to the same scale as in FIG. 1., the closure element being united from two closure members in combination with a carrier strip.
Figure 3:
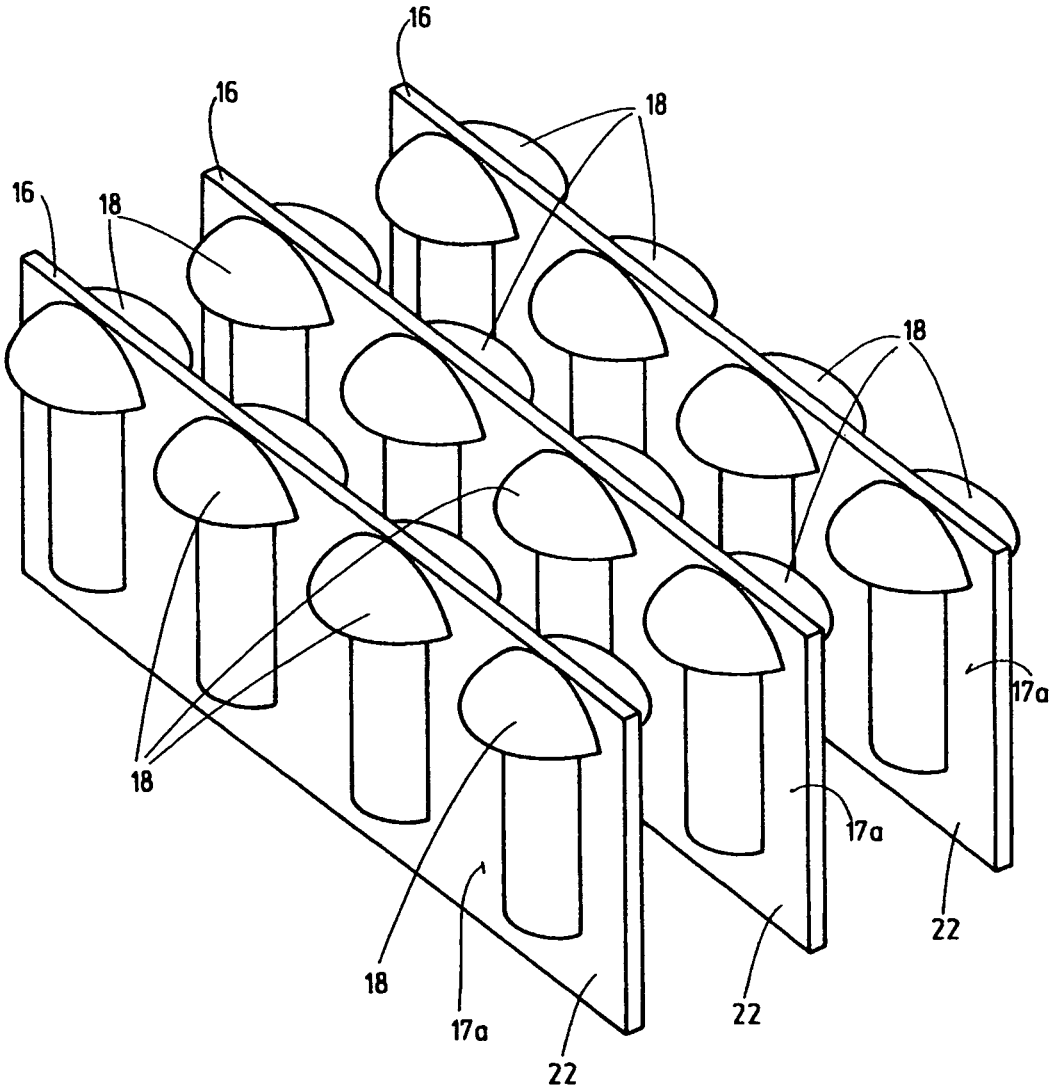
FIG. 3 is a perspective view of an exemplary embodiment of the closure part drawn according to a scale that is somewhat smaller than FIGS. 1 and 2, the closure part being formed with the closure elements shown in FIG. 2.

FIG. 2 shows an assembled closure element 18 formed by the combination of pairs of closure members 2 with a carrier strip 16. FIG. 3 shows four assembled closure elements 18, which are arranged in a row on a respective, continuous, flat carrier strip 16. In this case, FIG. 3 shows three rows of assembled closure elements 18, which form a subsection of a closure part. FIG. 2 also shows that the respective closure members 2 are in alignment with each other and lie flush over their entire surface with both their head face 10 and their stem face 12 with the one side and the other side of the carrier strip 16. The bottom end section 22 of the carrier strip 16 extends beyond the lower end 20 of the stems 4, so that this end section 22 forms an anchoring strip, with which the rows of closure elements 18 can be fastened on a carrier structure, a feature that is discussed in detail below with reference to FIG. 6.

The closure part has, as shown in FIGS. 3, 4, 5, 7, and 9, one or more web-shaped carrier strips 16, of which each comprises a pair of surface regions 17*a*, 17*b* that are arranged opposite each other. The surface regions 17*a*, 17*b*, which are arranged opposite each other, adjoin a connecting region 19—herein the underside of the respective carrier strip 16. In other words, the surface regions 17*a*, 17*b*, forming the side faces of the respective carrier strip 16, are arranged directly adjacent to the respective connecting region 19. The connecting region 19 can also extend over a bottom section of the respective carrier strip 16. At the surface regions 17*a*, 17*b*, individual closure members 2 protrude from the respective carrier strip 16, where the interlocking surfaces 24, provided on the closure elements 18 provide a possibility for securing additional closure parts of the same or different type. The closure members 2 and/or the closure elements 18, constructed from the interlocking heads 6 and/or the stems 4, lie on the surface regions 17*a*, 17*b* flush with the respective carrier strip 16 and are held permanently on the same in this way.

During production, separate closure members 2, as shown in FIG. 1, can be manufactured from a synthetic plastic material or metal material using a suitable molding process and can be connected, for example, by adhesive bonding, to the carrier strip 16. As an alternative, lengths of the carrier strip 16 can be integrally formed with the assembled closure elements 18, made of two closure members 2 at a time, using known production methods. Techniques, as disclosed, for example, in EP 1 047 539 B1 or DE 10 2004 012 067 A1, can be applied. Suitable materials include synthetic plastic materials, like polypropylene or polyamide, or materials from the group of acrylates, such as polymethacrylate, as well as polyethylene, polypropylene, polyoxymethylene, polyvinylidene fluoride, polymethyl pentene, polyethylene chlorotrifluoroethylene, polyvinyl chloride, polyethylene oxide, polyethylene teraphthalate, polybutylene teraphthalate, nylon 6, nylon 66, and polybutene. In the case of crosslinkable synthetic plastic materials, they can be post-crosslinked, for example, with ultraviolet light, after the closure elements 18 have been made. Thermoplastic materials and those that lend themselves well to thermosetting have proven to be especially suitable. Furthermore, aramide, PPS (polypropylene sulfites), or aromatic polyetherketones, for example, PEEK can be used.

Figure 4:
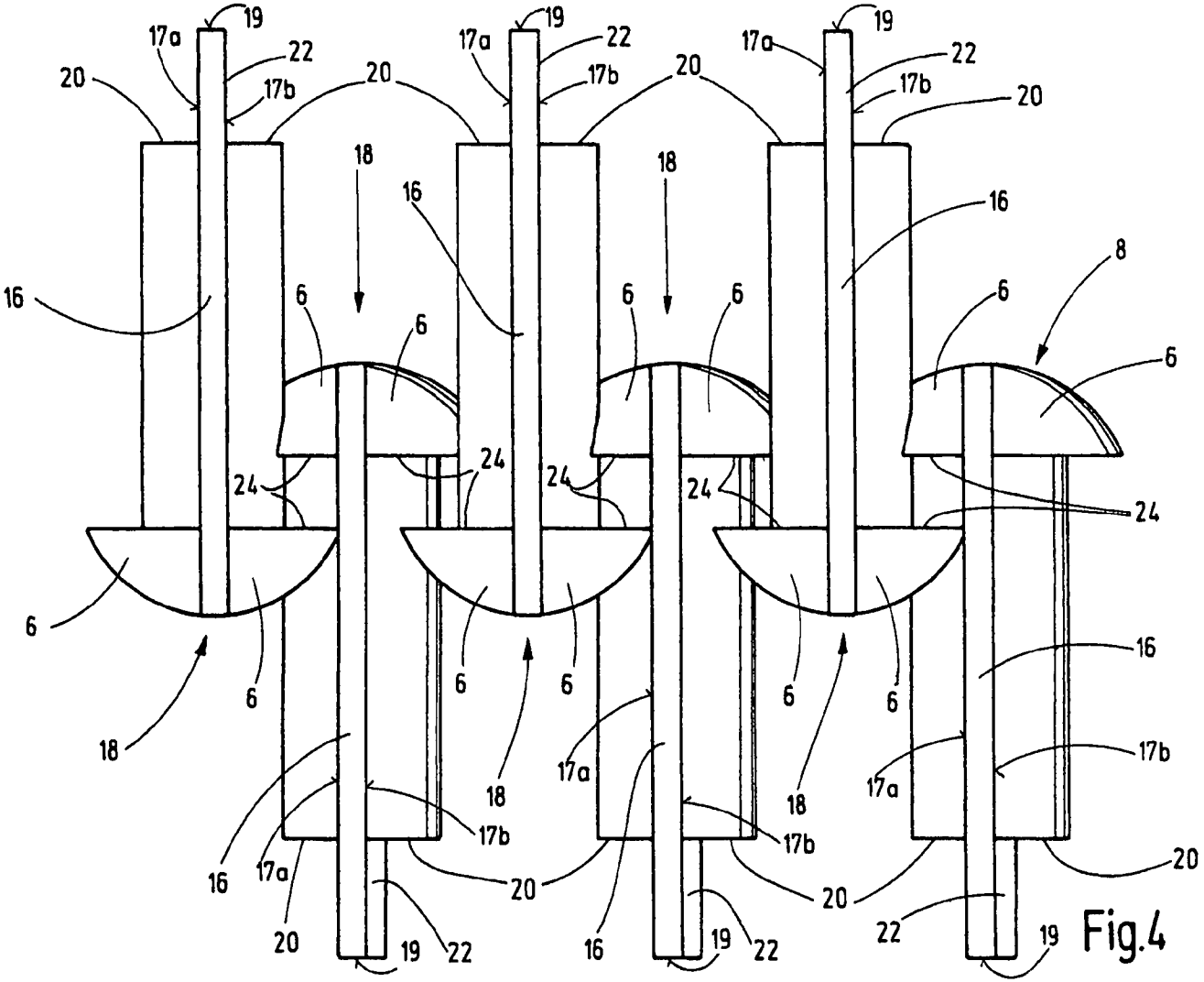
FIG. 4 is an elevational view of a hermaphroditic closure according to a larger scale, the closure being shown in an interlocking engagement without the respective carrier structure of the closure parts according to the invention.
Figure 5:
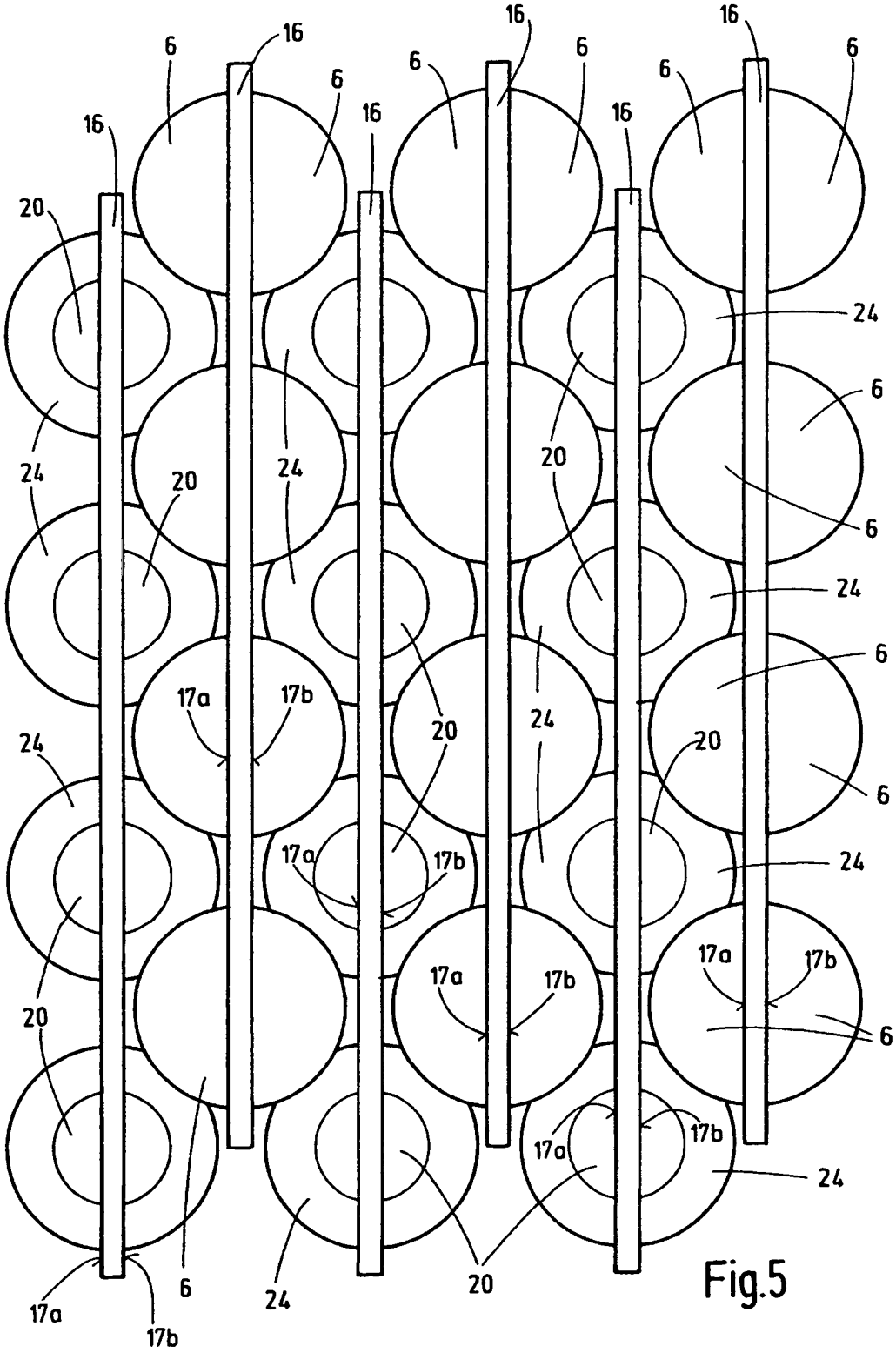
FIG. 5 is a top planar view of a surface section of the hermaphroditic closure, according to the example of FIG. 4, again without illustrated carrier structures of the closure elements.

FIGS. 4 and 5 illustrate the interlocking engagement between two inventive closure parts, forming a hermaphroditic closure, the connection of the respective end sections 22 of the carrier strips 16 not being shown. It is especially clear from FIG. 4 that in the interlocking state the holding force is formed by the interaction of the flat interlocking surfaces 24 on the interlocking heads 6. The planar abutment allows high holding forces to be attained, whereas the joining of the closure parts for forming an interlocking engagement requires a smaller amount of force to be expended, because the rounded off exterior surfaces of the heads 6 are overrun.

In FIG. 5, which illustrates the interlocking engagement, the interlocking surfaces 24 and the rest of the structural elements are only partially numbered in the interest of a better overview.

Figure 6:
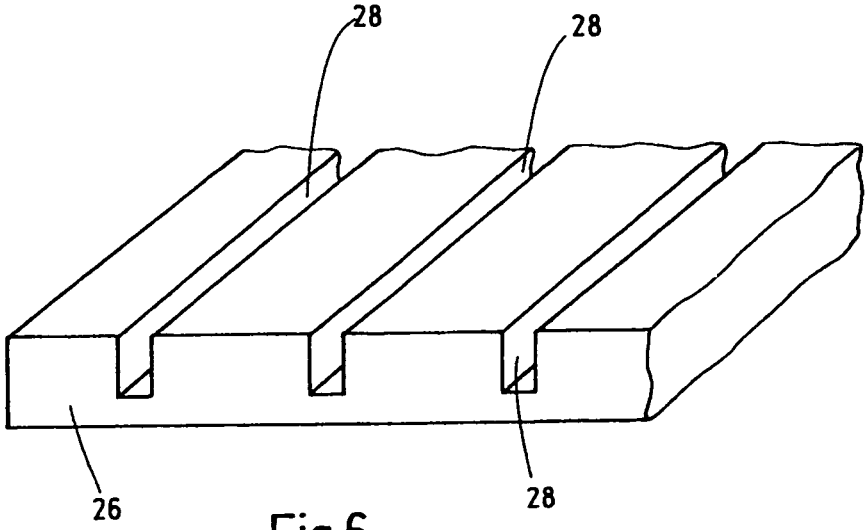
FIG. 6 is a partial perspective view of a base body, which serves as the carrier structure for the exemplary embodiment of FIGS. 4 and 5.

As stated above, FIGS. 2 to 5 do not show the carrier structure to which the closure elements 18 are fastened by the anchoring strips formed by the end sections 22 of the carrier strips 16 that project beyond the bottom ends 20 of the stems 4. FIG. 6 shows a corresponding carrier structure in the form of a base body 26 having the shape of a plate made of a synthetic plastic material that is easy to mold by injection molding. Anchoring grooves 28 forming a channel having a rectangular cross section are formed as the receptacles for the anchoring strips 26 formed by the end sections 22 of the carrier strips 16. The end sections 22 can be affixed by adhesive bonding in the anchoring grooves 28. Preferably, the manufacturing process is carried out in such a way that the respective base bodies 26 are populated by mechanical devices from a magazine that provides the components for insertion and that maintains a supply of the pre-finished lengths of the carrier strips 16 with the closure elements 18 located thereon, so that it is possible to achieve high production speeds.

Figure 8:
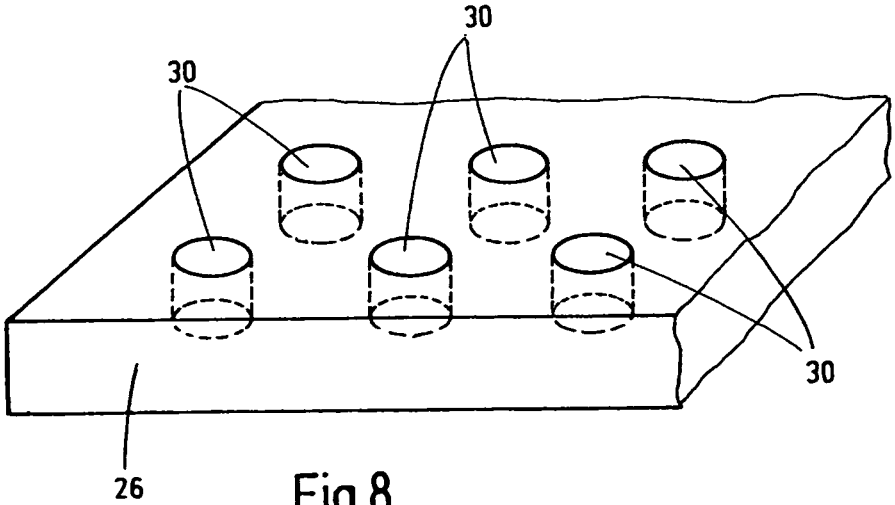
FIG. 8 is a partial perspective view of a subsection of a base body which serves as the carrier structure for the second exemplary embodiment of FIG. 7.
Figure 7:
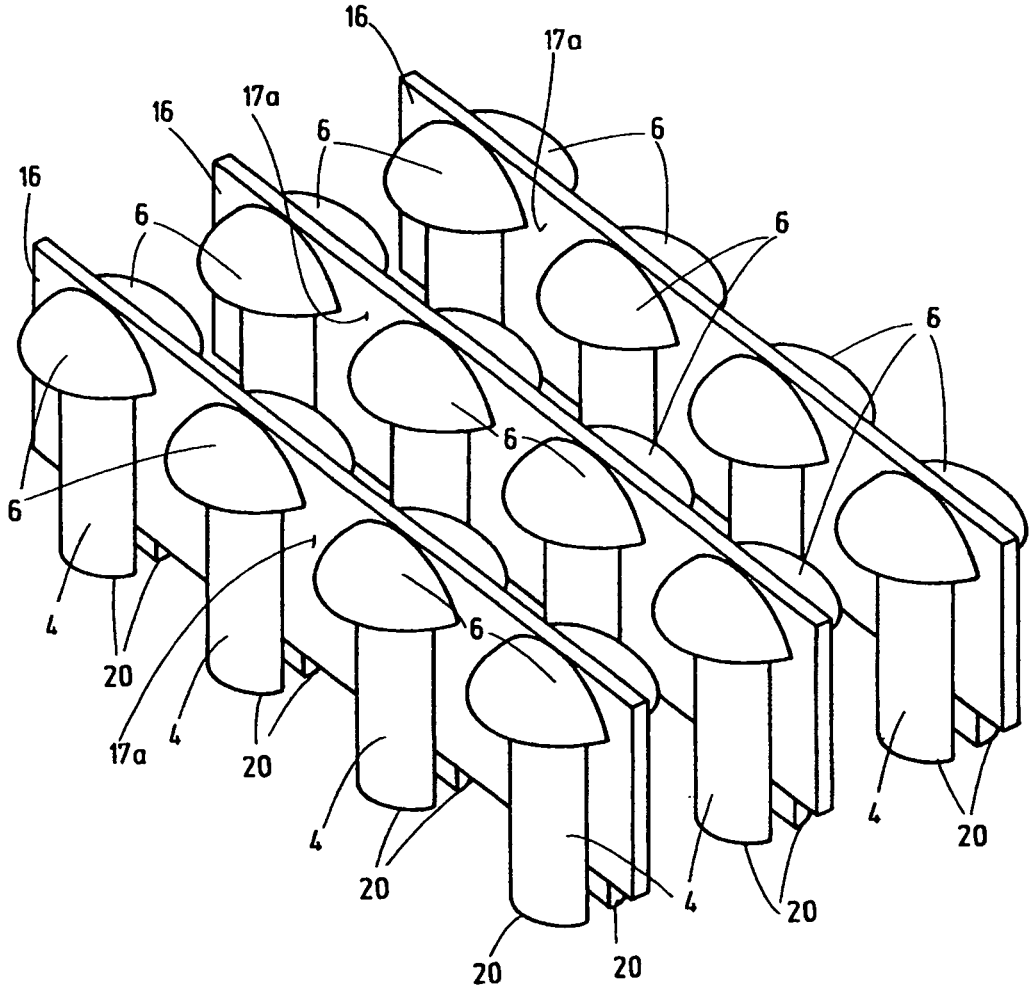
FIG. 7 is a perspective view of a second exemplary embodiment of a closure part according to the invention.

FIG. 7 depicts a modified exemplary embodiment, wherein the head faces 10 of the interlocking heads 6 may abut in their entirety flush with the carrier strip 16, but the free ends 20 of the stems 4 project beyond the end rim of the carrier strips 6. Therefore, adjoining the ends 20, the stems 4 form anchoring mandrels. In the present illustrated exemplary embodiment, circularly round mandrels protrude beyond the carrier strip 16. To receive the mandrels in the base body 26 shown in FIG. 8, recesses 30 are constructed in the form of circular cylindrical blind holes. Once again, the fastening may be done by adhesive bonding, so that a mechanical assembly of the base bodies 26 makes possible high production rates.

It is self-evident that, instead of stems 4 circumscribed by a circular cylindrical shape, non-round or polygonal stems could be provided. In this case, the shape of the recesses 30 would be adapted to match.

Figure 9:
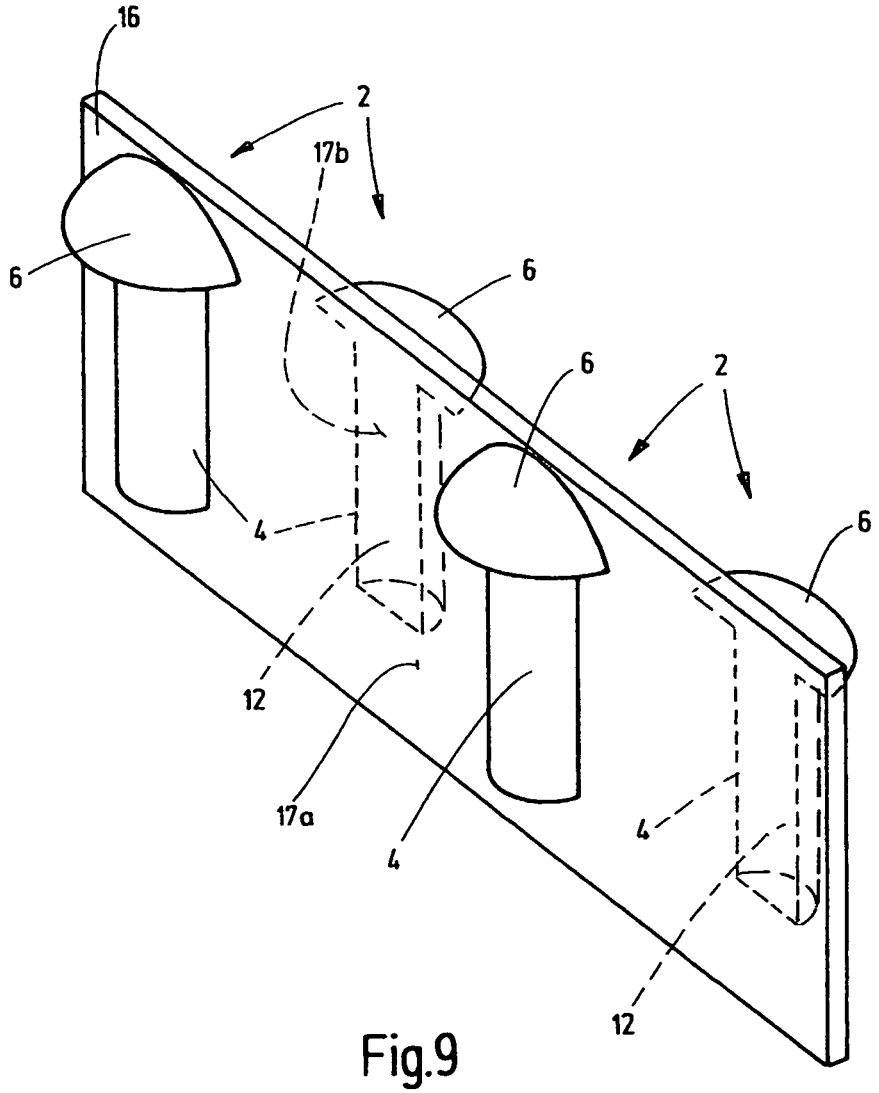
FIG. 9 is a perspective view of an arrangement of the individual closure members on a longitudinal section of a carrier strip according to a third exemplary embodiment of a closure part according to the invention.

In the preceding exemplary embodiments, the assembled closure elements 18 on the respective carrier strip 16 are formed by each closure member 2 on both sides of the carrier strip 16 being arranged in alignment with each other. FIG. 9 shows a modified example, where the closure members 2 on the one side of the carrier strip 16 do not lie in alignment opposite the closure member 2 on the opposite side of the carrier strip 16. Rather, in this case, rows of individual closure members 2 are formed on each side, with the rows being offset relative to each other such that the closure members 2 of the one row are placed centrally between two closure members 2 of the other row, forming an alternating series arrangement of closure members 2. Instead of the assembled closure elements 18 with two interlocking heads 6 each, only one respective closure member 2 with an interlocking head 6 forms the effective interlocking surfaces 24 on its underside. Once again, an identical design on the assigned closure part provided for the interlocking engagement can be provided to form the hermaphroditic closures. Corresponding exemplary embodiments are characterized by the smaller forces being required to bring about the interlocking engagement. Smaller holding forces can be achieved depending on the design of the interlocking heads 6 so that such closures can be configured such that it is possible to open, if required, the closure without having to apply excessive force.

Based on the drawing according to FIG. 9, it is also clear that a single closure member 2 may comprise only one interlocking head 6, provided that the individual stems 4 are omitted and the respective interlocking head 6 is then directly connected to the carrier strip 16, which then replaces the individual stems. In this way, the interlocking heads 6 can also be disposed on the carrier strip in a stepped arrangement in a variety of horizontal planes, based on the vertically oriented carrier strip 16. As stated above, the entire closure part, comprising the individual closure members 2, with the carrier strip 16 can be obtained in one molding process. However, there is also the possibility of first producing the carrier strip 16 separately from any other closure part and then inserting it, for example, according to the drawing of FIG. 1, into a gap between two adjacent closure members 2 and of connecting, for example, by adhesive bonding, the inserted closure member halves to the flat carrier strip.

The described closure systems can be formed as a single use closure system or, as presented, as closure systems that can be opened and closed over and over again. At any rate, the respective carrier strip 16 produces a longitudinal rigidity between the closure members 2 in such a way that, when suitably designed, the closure elements are held reliably in their locking position. As a result, the release forces are increased. If necessary, one embodiment (not shown in detail) provides additional carrier strips that may also engage in the form of rows between the illustrated carrier strips, so that the result for the entire closure system is a box like construction. In this respect, it is also possible to arrange a square outer peripheral frame (not shown in detail) around the longitudinal rows on the carrier strips 16.

While various embodiments have been chosen to illustrate the invention, it will be understood by those skilled in the art that various changes and modifications can be made therein without departing from the scope of the invention as defined in the appended claims.

What is claimed is:

1. A closure part for forming a hermaphroditic closure, comprising:

a web-shaped carrier strip having one pair of opposite surface regions and being connectable at least partially to a base body as a separate component along a connecting region;

individual closure members in at least one portion of said surface regions and located outside of said connecting region and adjacent to said connecting region, said closure members protruding from said carrier strip and being securable to additional closure parts of a same type or of a different type; and each said closure member including an interlocking head and a stem adjoining said interlocking head, said carrier strip being flush with said closure members with portions of each said interlocking head and each said stem being connected in a surface-to-surface manner to said connecting regions of said carrier strip.

2. A closure part according to claim 1 wherein each said interlocking head and each said stem are connected in the surface-to-surface manner over an entire axial extent of a longitudinal axis of each said stem.

3. A closure part according to claim 1 wherein said carrier strip protrudes beyond an end of each said stem spaced a distance from the respective interlocking head to form an anchoring strip in said connecting region, said anchoring strip being fastenable in an anchoring groove of the base body forming a carrier structure of the closing part.

4. A closure part according to claim 1 wherein each carrier strip ends in front of an end of each said stem spaced a distance from the respective interlocking head such that end regions of said stems protrude from said carrier strip to form fixing mandrels fastenable in recesses forming receptacles that are part of the base body forming a carrier structure of the closure part.

5. A closure part according to claim 1 wherein each said closure member of pairs of said closure members are aligned with one another on opposite sides of said carrier strip with said carrier strip being therebetween forming jointly an assembled closure element.

6. A closure part according to claim 5 wherein said closure members of each said pair are identical.

7. A closure part according to claim 5 wherein rows of assembled closure elements are arranged equidistant from one another and are formed on said carrier strip.

8. A closure part according to claim 1 wherein first and second rows of said closure members are arranged equidistant from one another and formed on opposite sides of said carrier strip, said closure members on said opposite sides of said carrier strip being offset from one another such that one of said closure members in said first row is located in an intermediate space between two adjacent ones of said closure members in said second row and vice versa.

9. A closure part according to claim 1 wherein the base body is connected to said connecting region of said carrier strip.

10. A closure part according to claim 9 wherein said base body comprises parallel anchoring grooves arranged equidistant from one another for successive carrier strips.

11. A closure part according to claim 9 wherein said base body comprises recesses forming receptacles arranged in parallel rows separated from one another.

12. A closure part for forming a hermaphroditic closure, comprising:

a web-shaped carrier strip having one pair of opposite surface regions and being connectable at least partially to a base body as a separate component along a connecting region;

individual closure members in at least one portion of said surface regions and located outside of said connecting region and adjacent to said connecting region, said closure members protruding from said carrier strip and being securable to additional closure parts of a same type or of a different type;

each said closure member including an interlocking head and a stem adjoining said interlocking head, said carrier strip being flush with said closure members; and said carrier strip protruding beyond an end of each said stem spaced a distance from the respective interlocking head to form an anchoring strip in said connecting region, said anchoring strip being fastenable in an anchoring groove of the base body forming a carrier structure of the closing part.

13. A closure part according to claim 1 wherein the base body is connected to said anchoring strip of said carrier strip and said base body having parallel anchoring grooves arranged equidistant from one another for successive carrier strips.

14. A closure part for forming a hermaphroditic closure, comprising:

a web-shaped carrier strip having one pair of opposite surface regions and being connectable at least partially to a base body as a separate component along a connecting region;

individual closure members in at least one portion of said surface regions and located outside of said connecting region and adjacent to said connecting region, said closure members protruding from said carrier strip and being securable to additional closure parts of a same type or of a different type;

each said closure member including an interlocking head and a stem adjoining said interlocking head, said carrier strip being flush with said closure members; and each carrier strip ending in front of an end of each said stem spaced a distance from the respective interlocking head such that end regions of said stems protrude from said carrier strip to form fixing mandrels fastenable in recesses forming receptacles that are part of the base body forming a carrier structure of the closure part.

15. A closure part according to claim 9 wherein the base body comprises recesses forming receptacles arranged in parallel rows separated from one another and receiving said end regions of said stems.

16. A closure part for forming a hermaphroditic closure, comprising:

a web-shaped carrier strip having one pair of opposite surface regions and being connectable at least partially to a base body as a separate component along a connecting region;

individual closure members in at least one portion of said surface regions and located outside of said connecting region and adjacent to said connecting region, said closure members protruding from said carrier strip and being securable to additional closure parts of a same type or of a different type; and first and second rows of said closure members being arranged equidistant from one another and formed on opposite sides of said carrier strip, said closure members on said opposite sides of said carrier strip being offset from one another such that one of said closure members in said first row is located in an intermediate space between two adjacent ones of said closure members in said second row and vice versa.

17. A closure part for forming a hermaphroditic closure, comprising:

a web-shaped carrier strip having one pair of opposite surface regions and being connected at least partially to a base body as a separate component along a connecting region;

individual closure members in at least one portion of said surface regions and located outside of said connecting region and adjacent to said connecting region, said closure members protruding from said carrier strip and being securable to additional closure parts of a same type or of a different type; and said base body having parallel anchoring grooves arranged equidistant from one another for successive carrier strips.

18. A closure part for forming a hermaphroditic closure, comprising:

a web-shaped carrier strip having one pair of opposite surface regions and being connected at least partially to a base body as a separate component along a connecting region;

individual closure members in at least one portion of said surface regions and located outside of said connecting region and adjacent to said connecting region, said closure members protruding from said carrier strip and being securable to additional closure parts of a same type or of a different type; and said base body having recesses forming receptacles arranged in parallel rows separated from one another.

* * * * *